US006131976A

United States Patent [19]

Silva

[11] Patent Number: 6,131,976

[45] Date of Patent: Oct. 17, 2000

[54] LOCK AND LIFT TOOL

[76] Inventor: Fred D. Silva, 16142 Via Descanso, San Lorenzo, Calif. 94580

[21] Appl. No.: 09/459,871

[22] Filed: Dec. 13, 1999

[51] Int. Cl.[7] ..... B66C 1/66

[52] U.S. Cl. ..... 294/97; 294/89

[58] Field of Search ..... 294/82.1, 82.13, 294/82.32, 89, 93, 95, 97, 104, 106; 52/122.1, 125.2, 125.3, 125.4, 707; 410/101, 102, 116

[56] References Cited

U.S. PATENT DOCUMENTS

| | | | |
|---|---|---|---|
| 956,938 | 5/1910 | Ciardelli | 294/89 |
| 1,851,116 | 3/1932 | Spiro | 294/95 |
| 1,938,485 | 12/1933 | Cossor | 294/89 X |
| 2,404,775 | 7/1946 | Ehmann | 294/89 X |
| 4,304,432 | 12/1981 | Silva | 294/93 |
| 4,575,144 | 3/1986 | Silva et al. | 294/97 |

*Primary Examiner*—Johnny D. Cherry
*Attorney, Agent, or Firm*—Linval B. Castle

[57] ABSTRACT

A tool for quickly coupling a crane hook to a dovetailed socket attached to a load consists of a heavy frame with a plate that pivots out on bushings near the lower end of the frame. Both the frame and pivoting plate have outward slanting surfaces at the lower ends that engage the dovetailed socket when the plate is pivoted up against the frame and they are locked together by a crane hook passing through aligned holes through both the plate and frame.

5 Claims, 4 Drawing Sheets

LOCK AND LIFT TOOL

This invention relates generally to material handling equipment and particularly to a device for coupling and locking a hook to a heavy article to be lifted such as a metal plate.

BACKGROUND OF THE INVENTION

The lock and lift tool of the invention is designed to quickly engage a rectangular dovetailed socket, one that has a rectangular top open surface but which has two inclined interior surfaces if observed in a sectional elevation view. The dovetailed socket may be cut near the center of a heavy metal plate or, preferably, in a small metal plate which may be bolted or otherwise attached to any heavy object, such as an engine block, which is to be moved or lifted by a crane.

A form of lock and lift tool is disclosed in U.S. Pat. No. 4,575,144, issued March 1986 to the present inventor. That tool is a three-piece tool having two plates with inclined bottom surfaces and a third locking plate which is dropped between the two plates to force the two plates apart into the dovetailed socket. A lifting cable passing through aligned openings in the three plates effectively locks the tool into the dovetailed socket. The three-piece tool functions very well if dirt doesn't make installation of the third locking plate difficult or if the third locking plate isn't lost.

The present invention is for a two-piece lock and lift tool that includes a main frame that has an inclined bottom surface and a pivoting plate that abuts against the main frame and has an inclined bottom surface. The pivoting plate may pivot out from the main frame for quick and easy release from or attachment to a dovetailed socket unless it is locked to the main frame by some means that holds the pivoting plate to the main frame such as a cable under tension or a lifting hook passing through aligned openings in the locking member and main frame.

Briefly described, the invention is for a tool for connecting a crane hook or cable to a load by expanding two inclined surfaces of the tool into a dovetailed opening formed in the load, or to a small plate attached to the load. The tool is quickly attached or released by removing the hook and pivoting out the pivoting plate from the main frame.

BRIEF DESCRIPTION OF THE DRAWINGS

In the drawings that illustrate the preferred embodiment of the invention.

DETAILED DESCRIPTION OF THE PREFERRED EMBODIMENT

Figure 1:
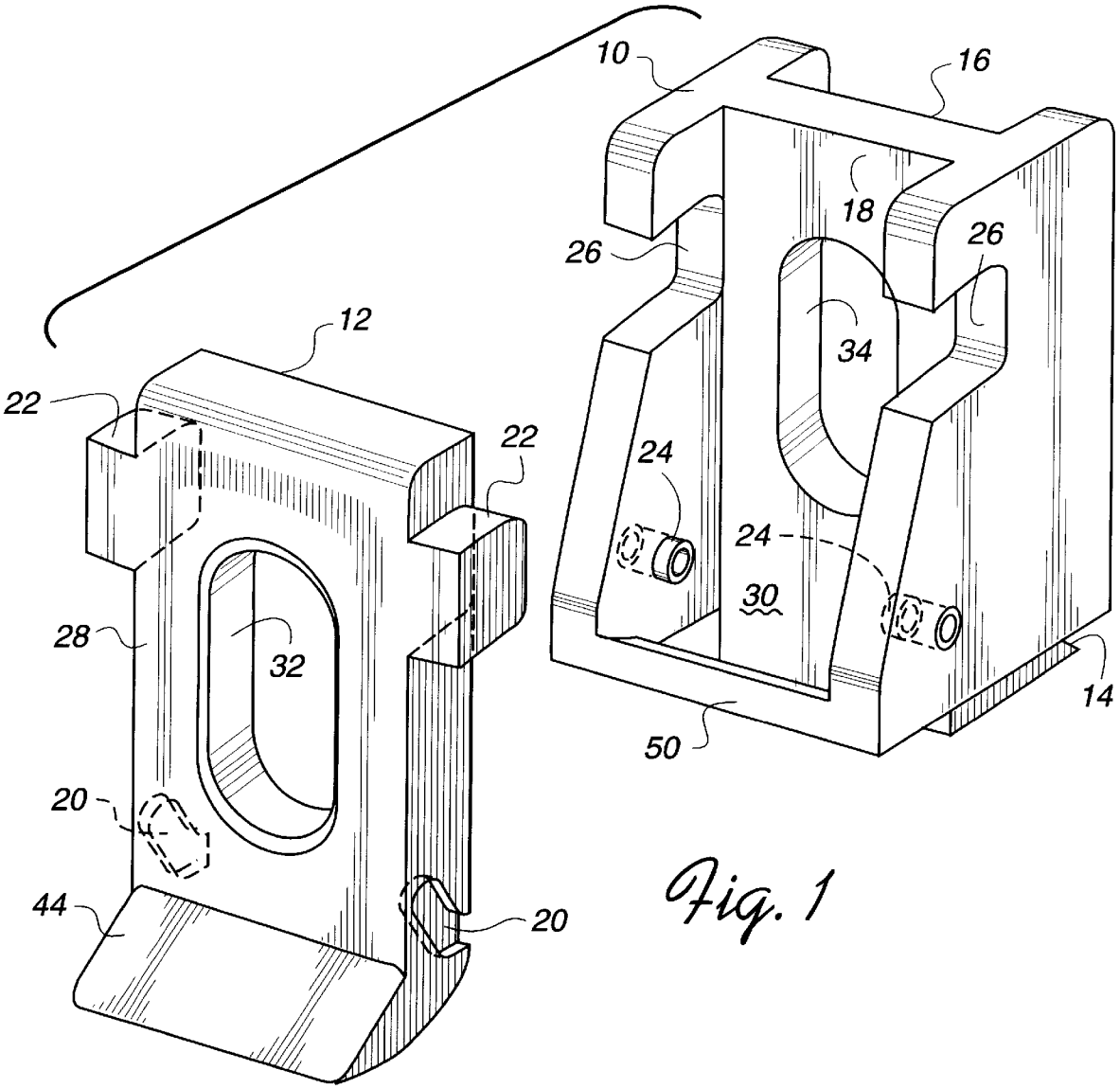
FIG. 1 is a perspective view of the main frame and pivoting plate.
Figure 5:
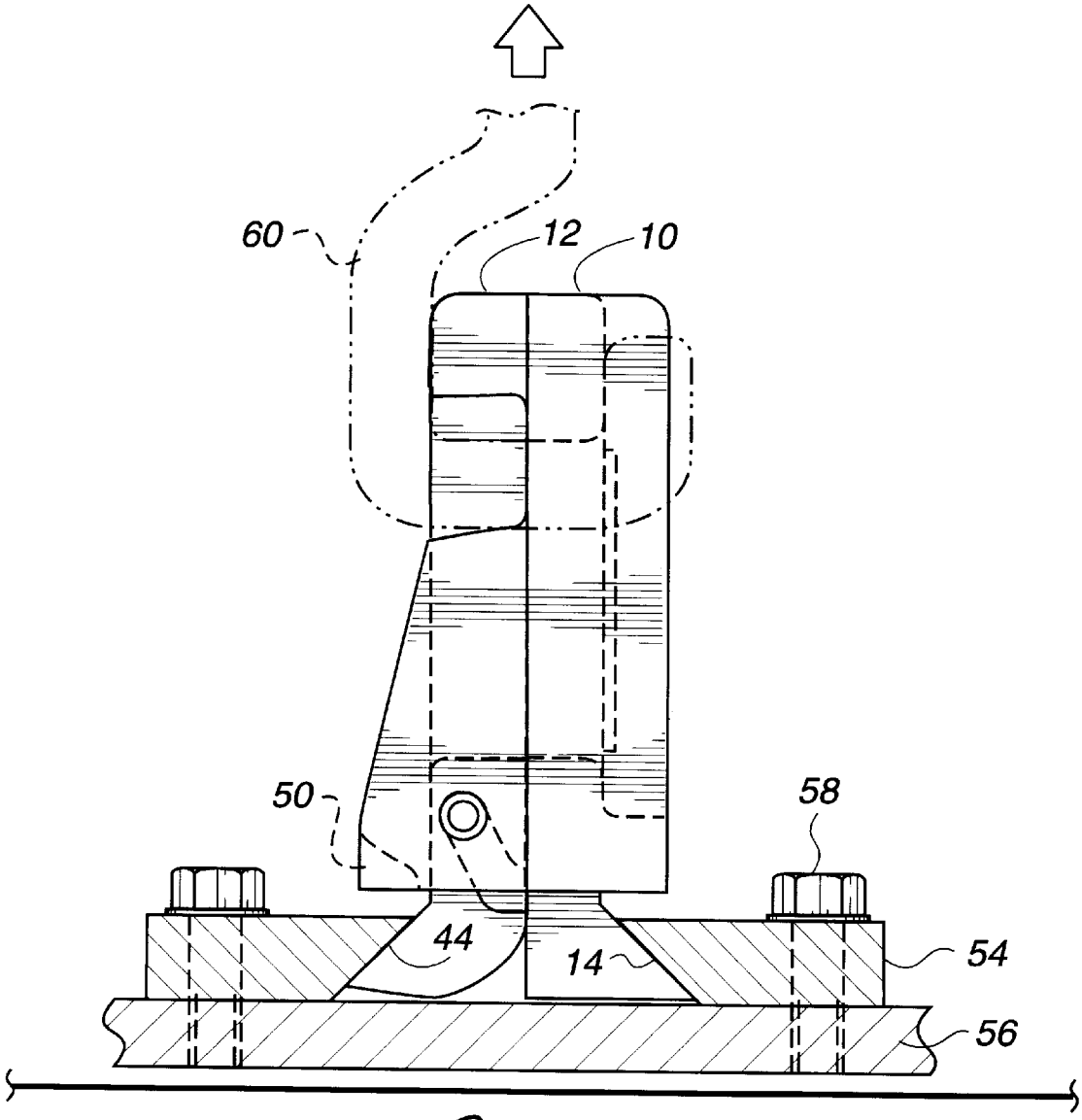
FIG. 5 is a side elevational view illustrating the main frame and pivoting plate engaging a dovetailed socket and locked together by a hook shown by broken lines.

The lock and lift tool of the invention comprises a main frame 10 and a pivoting plate 12 shown in FIG. 1, each of which have a 45 degree downward and outwardly inclined lower surface so that, when the frame and pivoting plate are properly meshed together, the surfaces can securely engage a dovetailed socket as shown in FIG. 5.

Figure 2:
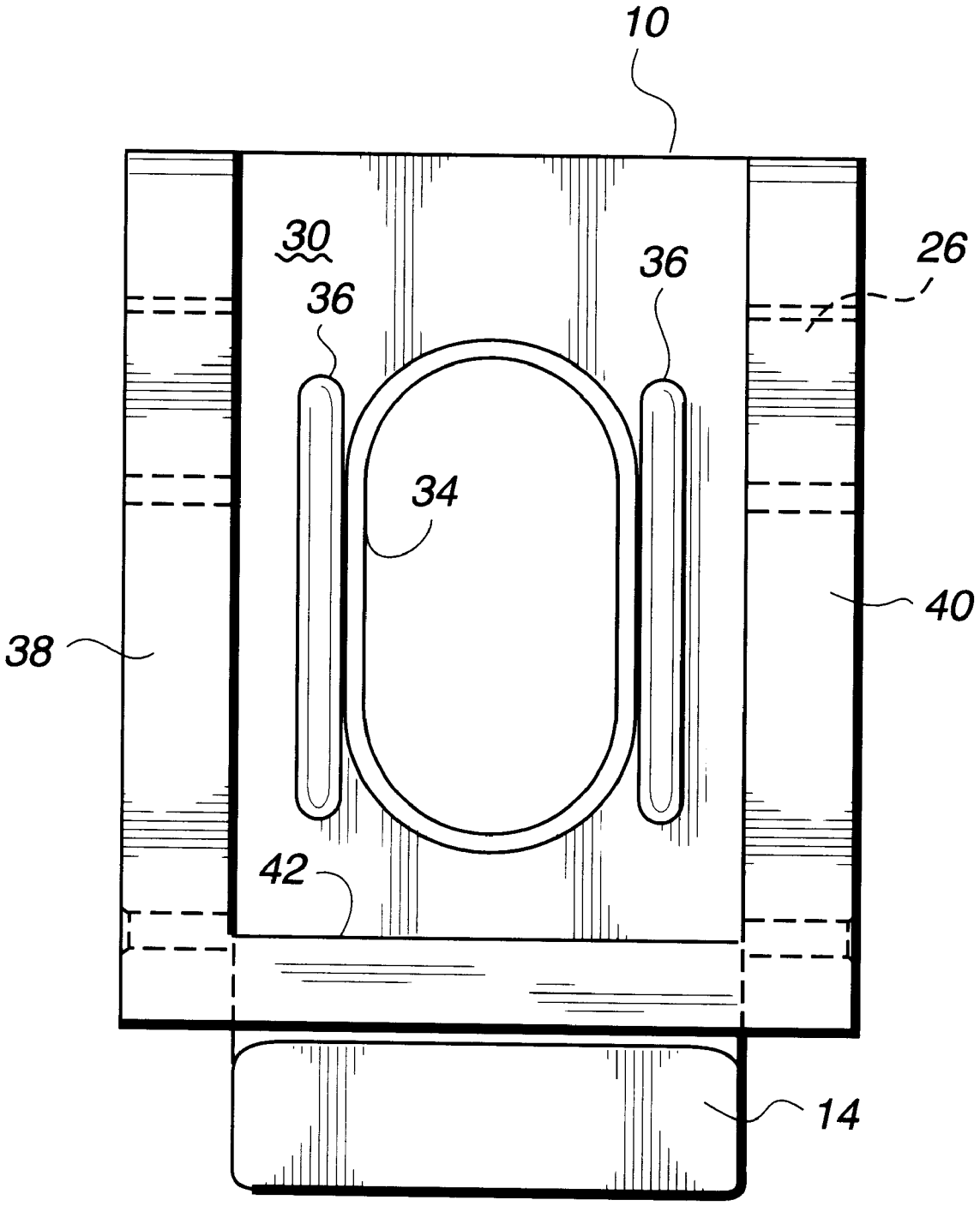
FIG. 2 is an elevational view of the front or channel side of the main frame.

The main frame 10 is preferably cast steel formed as an "H" in cross section and having a width of approximately three inches, a height excluding the inclined lower surface 14 of four inches, and wall thickness of one half inch. One side of the main frame 10 has side walls, is arbitrarily designated the front side 16, and is illustrated in FIG. 2. The opposite side 18 shown in FIG. 1 also has side walls and must accommodate the pivoting plate 12 which has side slots 20 that engage bushings 24 and side ears 22 that fit ear sockets 26 in the main frame side walls. When the pivoting plate 12 is meshed with the main frame 10, the side ears 22 on the pivoting plate are in the ear sockets 26 of the main frame and the wall 28 of the pivoting plate is contacting the center wall 30 of the main frame. In this position, a hook aperture 32 centered in the wall 28 of the pivoting plate 12 will be aligned with an identical hook aperture 34 in the center wall 30 of the main frame 10.

Figure 3:
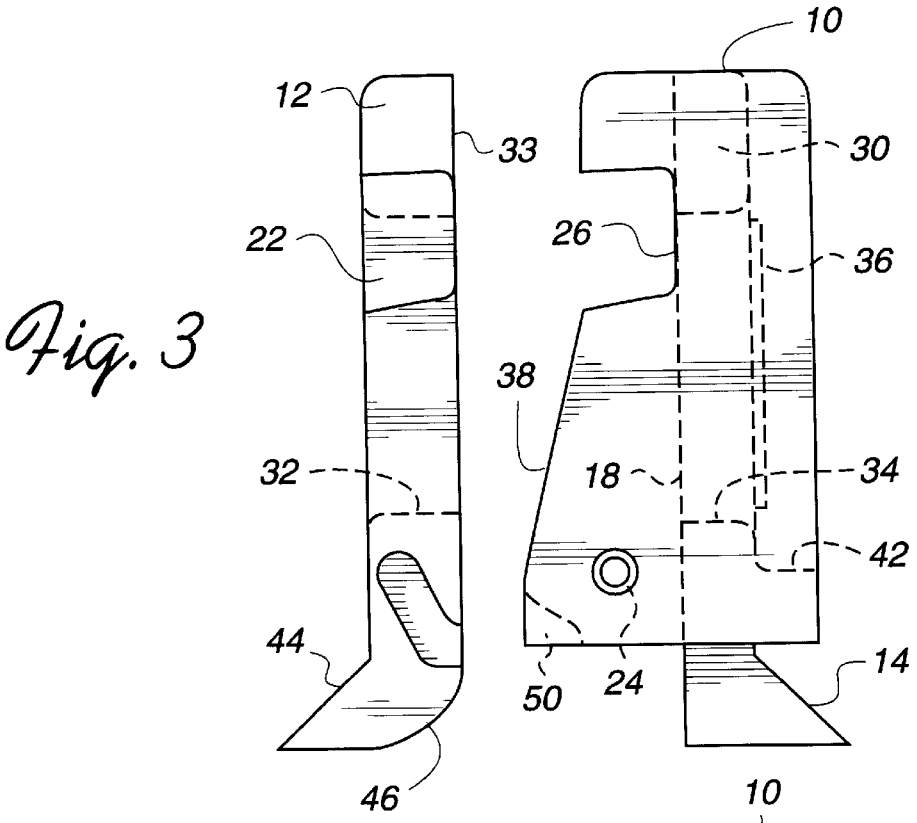
FIG. 3 is a side elevational view of the main frame and pivoting plate.

FIG. 2 is a front elevational view of the main frame 10 illustrating the center wall 30 with its central hook aperture 34 flanked by side strips 36 that protect the wall from crane hooks. The strips 36 are approximately one quarter of an inch wide and approximately an eighth of an inch thick above the surface of the wall. The center wall 30 extends between the side walls 38, 40 which are identical and which have holes for securing the bushings 24 and the sockets 26 for the ears on the pivoting plate 12. The center wall 30 of the main frame 10 extends down to a half inch thick deck 42 which is at a right angle to the wall 30 and extends out from the wall about half an inch as shown in FIG. 3. The inclined surface 14 that engages the dovetailed socket extends below wall 30.

Figure 4:
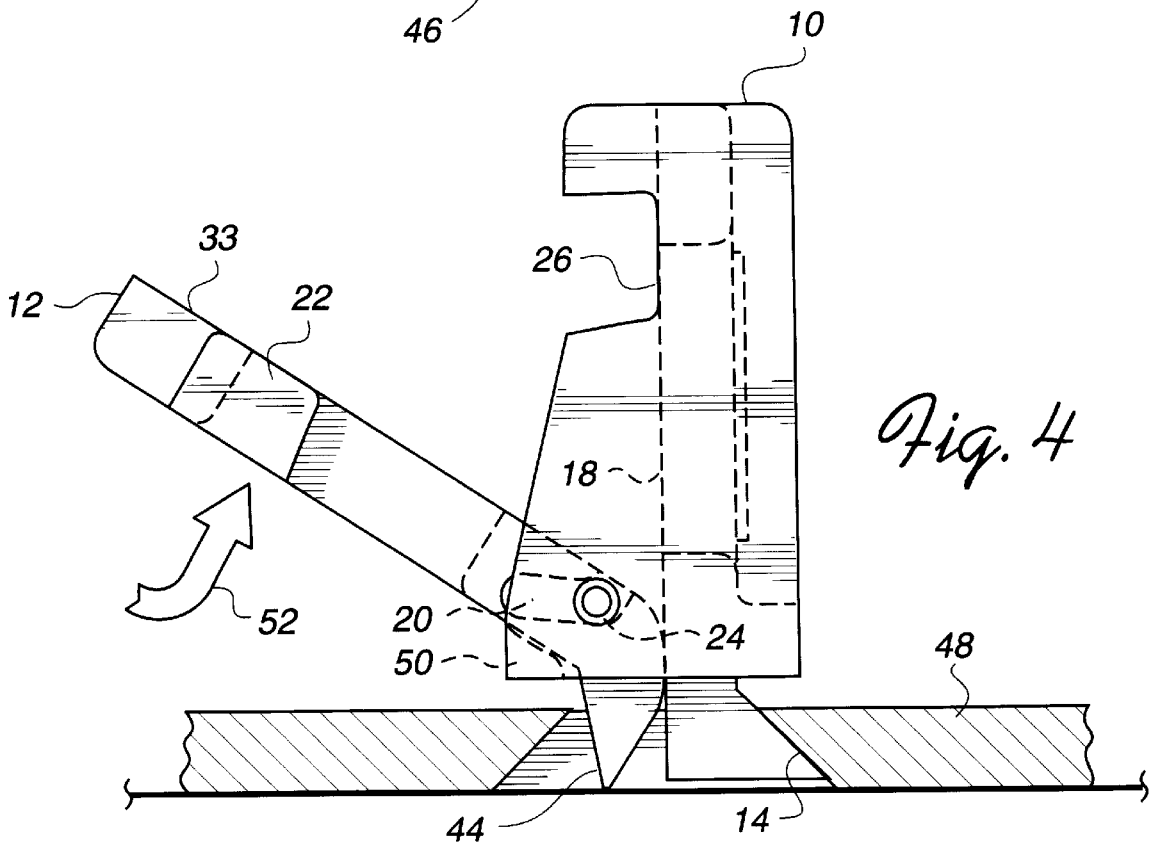
FIG. 4 is a side elevational view of the main frame and pivoting plate being inserted into a dovetailed socket.

FIG. 3 illustrates a side elevation view of the main frame 10 and pivoting plate 12 prior to assembly of the tool. On each of the two interior side walls 38, 40 of main frame 10, and mounted about a half inch from the lower edge of the side walls and a half inch from the surface of side 18 of the center wall 30, are coaxial bushings 24 which are secured through holes in the side walls and engage the slots 20 in the sides of the pivoting plate 12. The bushings and slots act as hinge pins and guide the pivoting plate as it is being opened and closed against the main frame as shown in FIG. 4. The bushings carry no weight other than that of the pivoting plate; the angle formed in the plate ears 22 and ear sockets 26 draws the plate against the main frame and weight is carried by the strong ears 22 and the ear sockets 26 in the walls of the main frame.

The slots 20 in the preferred embodiment are milled about one quarter inch wide and one eighth inch deep in the sides of pivoting plates 12 that are ⅝ inches thick. The forming of each slot requires first a milling at a right angle to the face 33 of the pivoting plate to a milling center of only about 5/32 inches from the face, thence to a second center point that is about ¼ inch further from the face and ½ inch closer to the ears 22 making the second milling at approximately 30 degrees from the face 33 of the pivoting plate. The diameter of each bushing 24 should be about 3/16 inches so that the pivoting plate 12 will loosely fit between the side walls of the main frame 10.

The pivoting plate 12 has an inclined lower surface 44 which, when the pivoting plate is closed against the main frame 10, is the mirror image of the 45 degree inclined lower surface 14 on the main frame. The corner between the bottom surface of the inclined surface and the face 33 has been rounded at 46 with a 5/8 inch radius curve so that the pivoting plate 12 may be mounted on the bushings 24 and may pivot in the main frame 10, as illustrated in FIG. 4.

FIG. 4 illustrates an assembled tool being engaged in a dovetail socket in a metal plate 48. To engage a dovetail slot the pivoting plate 12 is pivoted forward as shown in FIG. 4 until the lower inclined surface 44 on the pivoting plate has passed its vertical angle and the pivoting plate is resting at an angle of 30 degrees against the surface of the retainer bar 50 which connects the two side walls 38 and 40 of the main frame 10. The main frame may now be tilted so that its lower inclined surface 14 may be inserted into the dovetailed socket as shown in FIG. 4. Then the pivoting plate 12 is pivoted up, as shown by arrow 52, until the wall face 33 of the pivoting plate is in contact with center wall side 18 of the main frame and the pivoting plate's lower inclined surface 44 is inserted into the opposite leg of the dovetailed socket in the metal plate 48.

The dovetailed socket may be located near the center of gravity of a heavy metal plate as suggested by FIG. 4, or may be in small socket assemblies which are bolted to heavy objects that are often moved during assembly for example, engine blocks, railroad or truck components, as suggested by FIG. 5. As long as the pivoting plate 12 is clamped to the main frame 10 the tool is locked to the dovetailed socket and the load may be safely moved or lifted.

FIG. 5 illustrates the assembled tool with inclined surfaces 14, 44 closed in a dovetailed socket in a small metal plate 54 that is attached to a heavier load 56 by strong bolts 58. The wall face 33 of the pivoting plate 12 is contacting center wall side 18 of the main frame 10 and is locked against opening by a cable under tension or, preferably, by a crane hook 60 (shown by broken lines) which passes through hook apertures 32, 34 in the pivoting plate and main frame.

I claim:

1. A tool for the rapid attachment and release of a crane hook to a dovetailed socket, said tool comprising:

a main frame having a central wall with first and second sides, said first side having attached side walls, said main frame having an outward extending inclined surface at the lower end of said central wall and below said side walls;

pivoting bushings coaxially secured to the interior surface of said side walls of said main frame;

a pivoting member loosely fitting against the first side of said main frame central wall and between said side walls, said member having an outward extending inclined surface at the lower end that extends in the opposite direction to that in said main frame, said member having edge slots engaging said pivoting bushings extending from the interior side walls of said main frame, said pivoting member capable of pivoting forward from the main frame central wall to enable said inclined surfaces of said main frame and said pivoting member to enter a dovetailed socket; and aligned apertures through said pivoting member and said main frame central wall for installing a hook for locking together said main frame and said pivoting member.

2. The tool claimed in claim 1 wherein said main frame is formed of cast steel.

3. The tool claimed in claim 1 further wherein said main frame has a central wall with attached side walls on said second side of said central wall.

4. The tool claimed in claim 3 further including reinforcing strips cast in the second side of said central wall and adjacent said aperture through said main frame, said strips for protecting said aperture from damage by hooks applied through said aperture.

5. The tool claimed in claim 1 further including strong ears formed in each side edge of said pivoting plate, said ears mating with ear sockets formed in each side wall of said main frame, said ears and mating ear sockets for carrying the weight applied to said pivot plate.

* * * * *